US005941804A

United States Patent [19]

Johnston et al.

[11] Patent Number: 5,941,804

[45] Date of Patent: Aug. 24, 1999

[54] EXERCISE MACHINE FOR SIMULATING RUNNING

[76] Inventors: Allen K. Johnston, 3132 Crusade La., Green Bay, Wis. 54313; Greg Greer, 2728 79th Ave., CT, Milan, Ill. 61264

[21] Appl. No.: 09/137,280

[22] Filed: Aug. 20, 1998

Related U.S. Application Data

[60] Provisional application No. 60/083,319, Apr. 28, 1998.

[51] Int. Cl.[6] ..... A63B 21/06; A63B 23/04

[52] U.S. Cl. ..... 482/97; 482/51; 482/134; 482/137; 482/142

[58] Field of Search ..... 482/51, 52, 53, 482/97, 100, 137, 138, 134, 142

[56] References Cited

U.S. PATENT DOCUMENTS

| | | | |
|---|---|---|---|
| 3,759,511 | 9/1973 | Zinkin et al. . | |
| 4,067,571 | 1/1978 | Rogers . | |
| 4,108,435 | 8/1978 | Coleman . | |
| 4,186,922 | 2/1980 | Ketchum . | |
| 4,508,341 | 4/1985 | Carrington . | |
| 4,511,137 | 4/1985 | Jones | 482/100 |
| 4,573,680 | 3/1986 | McNally . | |
| 4,736,947 | 4/1988 | Jenkins . | |
| 4,802,670 | 2/1989 | Smith . | |
| 5,106,000 | 4/1992 | Jones | 482/97 |
| 5,143,372 | 9/1992 | Wilson . | |
| 5,462,272 | 10/1995 | Staten . | |
| 5,656,003 | 8/1997 | Robinson et al. | 482/100 |
| 5,685,804 | 11/1997 | Whan-Tong et al. . | |

*Primary Examiner*—John Mulcahy
*Attorney, Agent, or Firm*—John A. Thomas

[57] ABSTRACT

An exercise machine for simulating running comprises a frame having a rear portion and a forward portion, a shoulder harness supported by the forward portion of the frame for supporting the upper body in a fixed position, a pair of hand grips juxtaposed near the shoulder harness, a pair of lever arms each having an upper end and a lower end with the upper ends pivotally connected to the rear portion of the frame, a pair of foot assemblies extending outwardly from the lower ends of the lever arms and rotatable through an arc of not more than 180 degrees, and a pair of resistance means attached to the lever arms.

8 Claims, 3 Drawing Sheets

EXERCISE MACHINE FOR SIMULATING RUNNING

CLAIM FOR PRIORITY

This application claims the benefit of the filing date of that certain provisional patent application disclosing the same invention, titled "Exercise Machine for Simulating Running" and filed Apr. 28, 1998 under application Ser. No. 60/083,319.

BACKGROUND OF THE INVENTION

1. Field of the Invention

This invention relates to an exercise machine that accurately simulates running, sprinting or jumping movements and can be used as a leg press.

2. Description of Related Art

Both athletes and non-athletes utilize exercise machines to build strength, to prevent injury and/or to improve overall physical condition. There are numerous exercise machines known in the art. Generally, each machine exercises a certain part of the body or a certain set of muscles. Athletes often use exercise machines designed to improve performance of muscles required for their particular sport.

Of particular interest to football players are the muscles used for running, jumping and sprinting. While many exercise machines exercise the leg muscles involved in those maneuvers, no known exercise machine utilizes all of the same muscles in the same manner as those muscles are used in the natural movements of running, jumping and sprinting.

One machine that attempts to simulate running is described in U.S. Pat. No. 3,759,511, issued Sep. 18, 1973 to D. W. Zinkin, et al. While the Zinkin, et al. machine simulates many muscle movements of running, the limited movement of the foot in the foot receiving plates of the Zinkin, et al. make it impossible to simulate the natural movements of running, sprinting or jumping. Additionally, during use of the Zinkin, et al. machine, the torso slides forward on the body support because there is no means for keeping the upper body in a fixed position. This reduces the resistance against which the legs are exercised and reduces the effectiveness of the machine.

There is a need for an exercise machine that closely simulates the natural movements of running, sprinting and jumping. Further, there is a need for such an exercise machine that is flexible so that it may be adjusted to enhance the exercise of specific muscle groups. Finally, there is a need for such an exercise machine to provide a convenient range of resistances so that it may be used not only for conditioning of active athletes but also for rehabilitation of injured athletes.

SUMMARY OF THE INVENTION

An exercise machine for simulating running, comprises a frame, with the frame having a forward portion and a rear portion. A shoulder harness is connected to the forward portion of the frame for supporting the torso of the user and preventing the forward movement of the user's body. Two lever arms are pivotally connected to the rear portion of the frame. A pedal assembly is connected to each lever arm for receiving the foot of the user. A means for connecting removable weights to each lever arm is attached to each lever arm, so as to provide a torque about the respective pivot, and thereby impose a resistance to the leg movements of a user.

The exercise machine may further comprise an adjustment means for lowering and raising the rear portion of the frame relative to the forward portion.

DETAILED DESCRIPTION OF THE PREFERRED EMBODIMENTS

Figure 1:
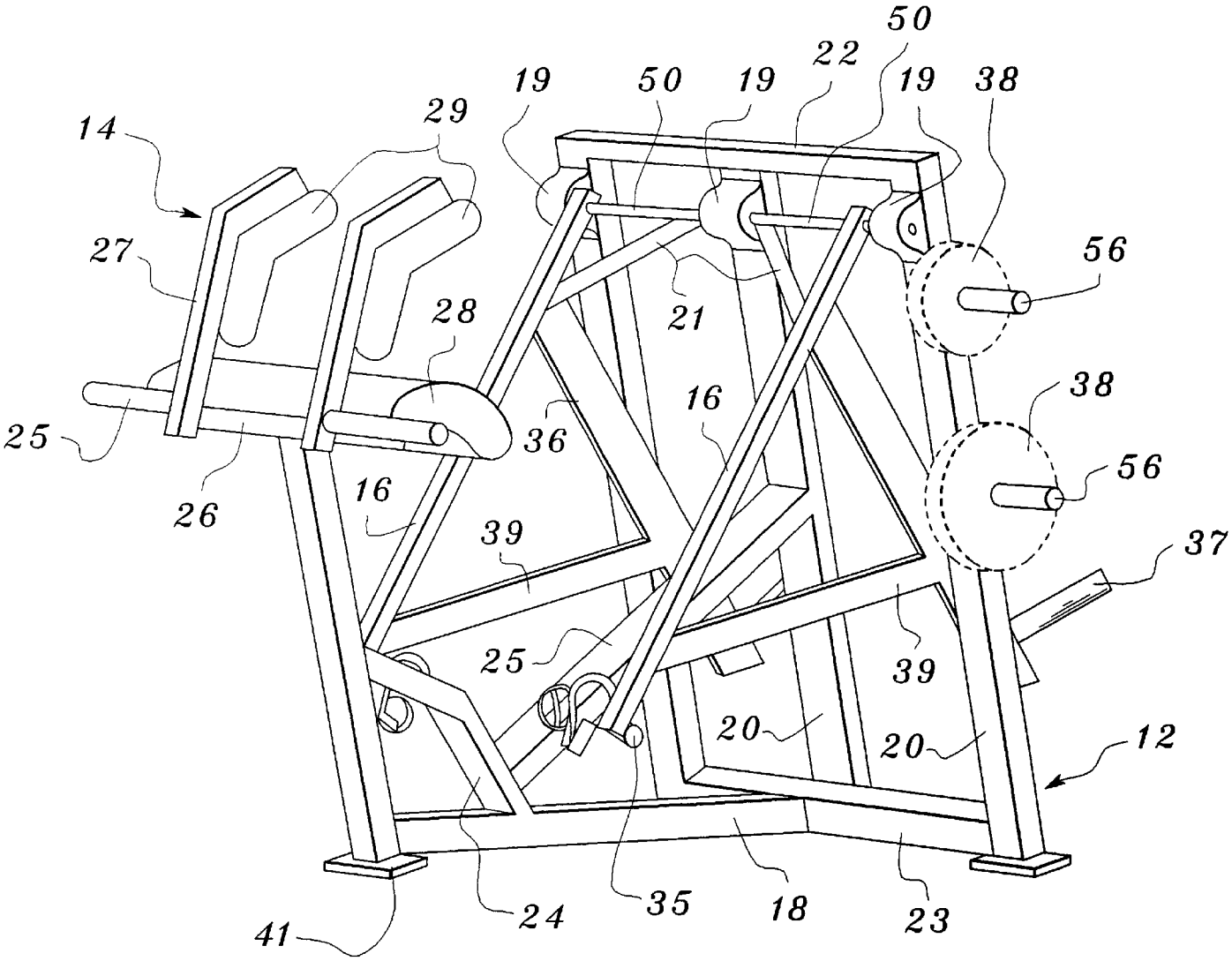
FIG. 1 is a perspective side view of the exercise machine of the present invention, showing a runner in dotted outline.

Referring to FIGS. 1 through 4, the exercise machine 10 of the present invention comprises a frame 11 having a rear portion 12 and a forward portion 13. A shoulder harness 14 is supported by the forward portion 13 of the frame 11. Juxtaposed near the shoulder harness 14 are a pair of hand grips 15. A pair of lever arms 16, each having an upper end and a lower end, are pivotally connected at the upper ends to the rear portion 12 of the frame 11. Extending outwardly from the lower ends of the lever arms 16 are a pair of pedal assemblies 17, detailed in FIG. 3, each pedal assembly 17 rotatable through an arc of not more than 180 degrees. Each lever arm 16 has a means to attach removable weights. In the preferred embodiment, this means is a hub 37 upon which standard removable weights may be placed.

As shown in the figures, rear portion 12 of the frame 11 is connected to the forward portion 13 of the frame 11 by base portion 18. Preferably, rear portion 12 comprises three vertical supports 20, all connected by horizontal supports 22 and 23 at the upper and lower ends respectively. Preferably, the forward portion 13 of the frame 11 comprises a single vertical support connected at its lower end to the base portion 18. To stabilize the frame 11, support pieces 24 and 25 may be affixed between the base portion 18 and the vertical support 20 of the rear portion 12 and the forward portion 13. Base plates 41 may be attached to the frame 11 where the frame 11 contacts the floor to provide additional stability during use.

All parts of the frame 11 are constructed of substantially rigid elongated tubular bars or rods preferably from a metal such as steel. The parts of the frame 11 are connected by welding, bolts or other means for creating rigid joints.

Figure 2:
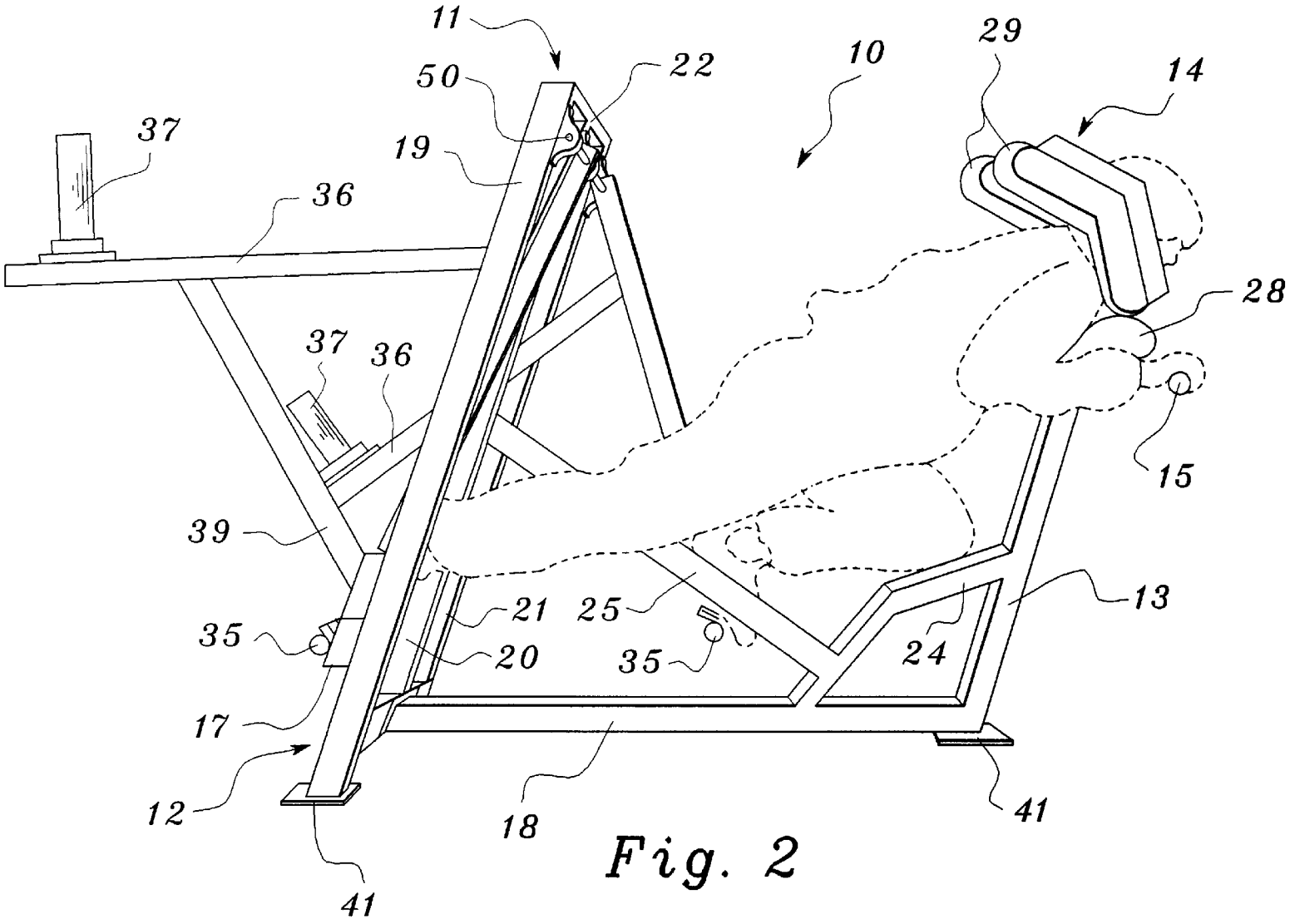
FIG. 2 is a side view of the exercise machine, showing a runner in dotted outline.

As shown in FIGS. 1 and 2, shoulder harness 14 comprises a horizontal chest support 26 and two vertical shoulder stops 27. Chest support 28 is affixed to the horizontal chest support 26 for supporting the torso of the user. Chest support 28 may be of a firm foam material to provide a cushioned support for the comfort of the user. Preferably, affixed to vertical shoulder stops 27 are two shoulder cushions 29. The shoulder stops 27 keep the user's torso from sliding forward during use.

Two hand grips 15 are provided juxtaposed near the shoulder harness 14 for the user to grasp to stabilize the user during use. The hand grips 15 may be affixed to the shoulder harness 14, as shown in the drawings, or may extend from the forward portion 13 of the frame 11 (not shown in the drawings).

The lever arms 16 are pivotally connected at their upper ends to the rear portion 12 of the frame 11 preferably by an axle 50 passing through bearings, such as the sealed pillow block bearings 19 shown in the figures. Preferably, the lever arms 16 are approximately 107 cm (42 inches) in length, measured from the pivot point to the foot assembly 17. Although this is the optimum length, the length can vary by three or four inches in either direction. At the optimum length of 107 cm (42 inches), the user is able to attain a full lock-out position of the thrusting leg during use. This assists the user in closely simulating the movements of running and sprinting while using the exercise machine 10. The lever arm 16 and the axle 50 combination are stabilized in the preferred embodiment with braces 21.

Figure 3:
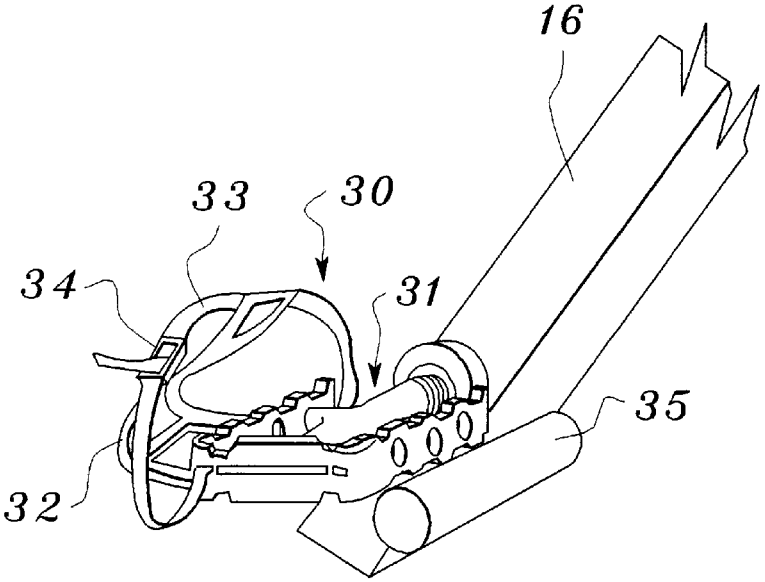
FIG. 3 is a perspective view of one embodiment of the foot assembly of the present invention.

At the lower end of the lever arms 16 are affixed a pair of pedal assemblies 17. Each pedal assembly 17 preferably comprises a bicycle pedal 30 as shown in FIG. 3. Each pedal assembly 17 further comprises a foot grip 31, a toe clip 32, and a strap 33 which can be adjusted by strap adjuster 34 for securing the user's foot to the pedal 30. The rotation of each pedal 30 is limited to an arc of less than 180 degrees by pedal stop 35 which is placed in the path of rotation of the pedal 30 as shown in FIG. 3. The purpose for pedal stop 35 is for safety and convenience. Pedal stop 35 stabilizes pedal 30 making it easier and safer to mount and dismount from the exercise machine 10.

Preferably, the distance between the pedals is approximately 51 cm (20 inches) but may vary from 35 cm to 66 cm (14 to 26 inches). At 51 cm (20 inches), the distance between the user's feet while using the exercise machine 10 closely approximates the distance between the feet during normal running and sprinting; thus, closely simulating normal muscle movements of running and sprinting.

Attached to the lever arms 16 are a pair of weight arms 36 connected at their upper ends to the lever arms 16 at the upper ends of the lever arms 16. At the lower ends of the weight arms 36 are affixed a pair of hubs 37 for receiving removable weights 38. To stabilize the weight arms 36, bars 39 are affixed between the lower ends of the weight arms 36 and the lower ends of the levers arms 16. As shown in FIG. 2, weights 38 may be stored on a plurality of pegs 56 attached to the frame at locations, such as the sides, where the stored weights will not interfere with the movement of the lever arms 16 or any other part of the exercise machine 10.

As will be appreciated by one skilled in the art, the length of the weight arms 36 determines the force needed to move the lever arms 16 from the lower ends of the lever arms 16 where the user applies force from the pedal assemblies 17. While the optimum length of the weight arms 36 is 91 cm (36 inches), the length can vary from 38 cm to 114 cm (15 to 45 inches).

Figure 4:
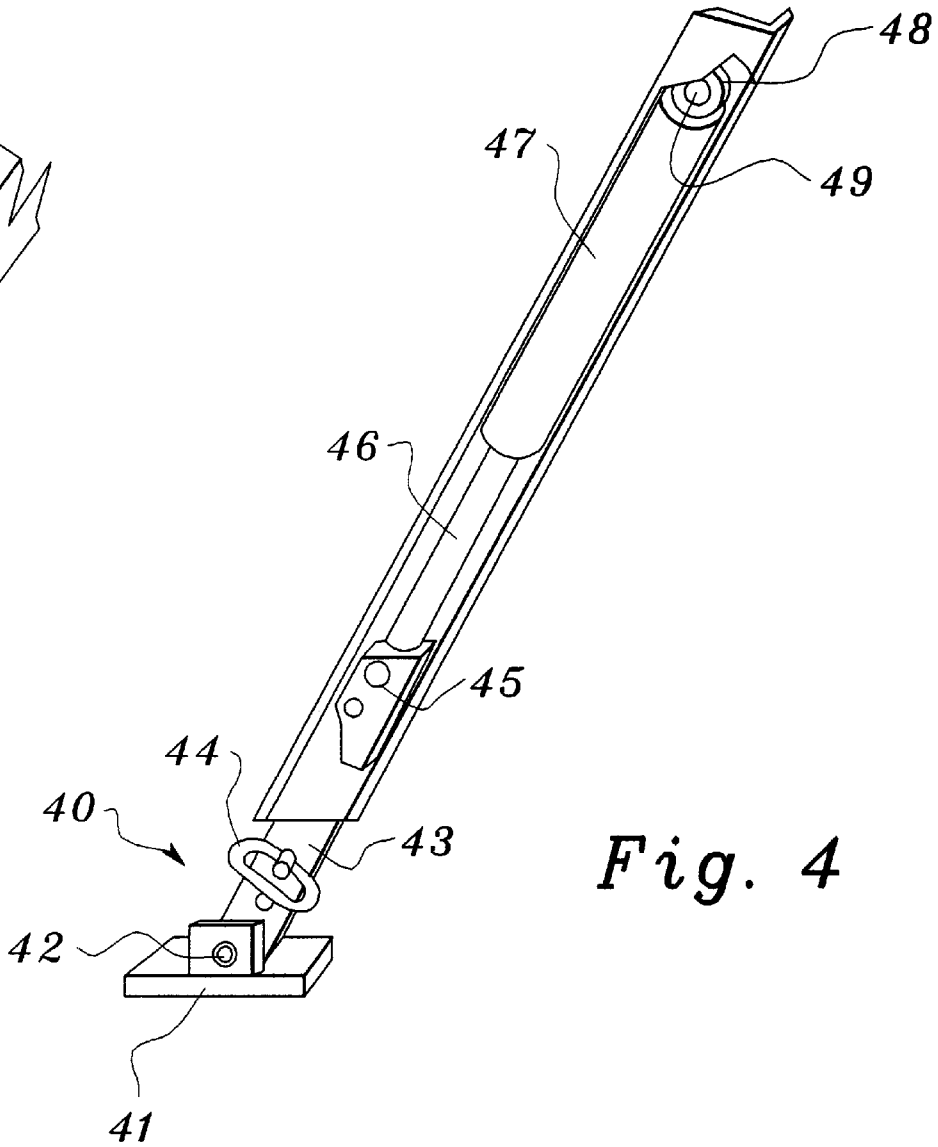
FIG. 4 is a perspective side view of an adjustment means for raising and lowering the rear portion of the frame relative to the forward portion.

An alternative embodiment of the exercise machine 10, as depicted in FIG. 4, further comprises a means for lowering and raising the rear portion 12 of the frame 11 relative to the forward portion 13 of the frame 11. Preferably, the rear portion 12 of the frame 11 may be raised approximately 36 cm (14 inches) relative to the forward portion 13 of the frame 11.

The means for raising and lowering the rear portion 12 of the frame 11 may comprise a rear foot assembly 40 having a base plate 41 pivotally connected at a pivot point 42 to foot adjustment leg 43. The foot adjustment leg 43 fits telescopically into the lower end of the rear portion 12 of the frame 11. A means is provided for locking the foot adjustment leg 43 in a pre-determined position relative to the rear portion 12 of the frame 11. In the preferred embodiment this means for locking comprises the foot adjustment leg 43 having a plurality of equally spaced adjustment openings 45 for receiving a pull pin 44. The rear portion 12 of the frame 11 rests on the pull pin 44, and prevents the frame 11 from sliding downward, thus determining the relative height of the rear portion 12 of the frame 11 to the forward portion 13 of the frame 11. To accommodate the raising and lowering of the rear portion 12 of the frame 11, base plate 41 is also pivotally affixed to the forward portion of 13 of the frame 11 at a pivot point 42.

Preferably, as depicted in FIG. 4, the foot adjustment leg 43 is attached at its upper end to the shaft 46 of a gas-charged lift support (commonly called a "gas shock") 47 to make it easier to adjust the rear portion 12. Without the gas-charged lift support 47, the weight of exercise machine 10 may be so great as to make it difficult to raise the frame 11 to move pull pin 44 to raise or lower the rear portion 12 of the frame 11 relative to the forward portion 13. Gas-charged lift support 47 has a bolt receiving portion 48 connected to the gas-charged lift support 47 at the end opposite the shaft 46. Alternatively, the gas-charged lift support could be connected in the opposite direction. The gas-charged lift support 47 is bolted by bolt 49 to the rear portion 12 of the frame 11. Gas-charged lift support 47 is a typical lift support device used on exercise equipment. Other gas or oil charged lift supports, or springs, could also be used.

While the operation of the previously described embodiments of the present invention are apparent from the description and drawings, not all the operational advantages may be clearly apparent and will be explained at this point.

The embodiments depicted in the figures can be used for both running and for leg presses. Prior to use, the removable weights 38 desired for resistance are placed on hubs 37 and the user adjusts straps 33, using strap adjusters 34, so the user's feet will fit snugly into toe clips 32. The user then holds onto hand grips 15 for stability and is supported by engagement of the upper torso of the user with the chest support 28 while the user's feet are slipped into the toe clips 32 of the pedals 30 with the feet resting on the foot grips 31. With one leg, the user thrusts rearward while simultaneously lifting forwardly with the other leg to simulate running, sprinting or jumping.

Because of the configuration and arc rotation of the foot pedals 30, the user is able to pivot from the ball of the foot to the toe to simulate the natural process of running or sprinting. Additionally, the thrust leg can achieve a full lock-out position not possible with existing exercise machines. Finally, the distance between the pedals 30 closely resembles the distance for natural sprinting movements and allows for improve stride simulation. The simulation of natural running and sprinting is also enhanced by use of the shoulder harness 14 which keeps the trunk of the user's body in a fixed position by preventing it from sliding forward.

With the embodiment depicted in FIG. 5, the rear portion 12 of the exercise machine 10 is adjustable relative to the forward portion 13. When the rear portion 12 is elevated, the load is transferred more specifically to the hamstring and gluteal muscles. This enables the user to target specific muscles used in running, sprinting and jumping.

Leg presses can be performed in two distinct methods with the exercise machine 10. By pressing into the toe clips 32, depicted in FIG. 3, the weight will be pressed using the ball of the foot. This allows for enhancement of the use of the quadriceps. Alternatively, the leg presses can be performed using the heel of the foot by pressing the heel of the foot against foot grips 31. By pressing with the heel of the foot, the load is primarily placed on the ham string muscles allowing the user to train the ham string muscles as hip extensors rather than as knee flexors. Pressing with the heel also conditions the gluteal muscles invalid in the natural movements for running, jumping and sprinting.

Because the resistance may be varied through the addition or removal of removable weights 38, the exercise machine 10 can be used as a leg press with the body in a running or sprinting position by increasing the number of removable weights 38 added to the hubs 37. While in a running or sprinting position, the leg presses are performed alternately with one leg and then the other. By conducting leg presses in the running or sprinting position, the athlete may condition the specific muscles involved in those movements.

Additionally, by adding and removing the removable weights 38 from the hubs 37, the exercise machine 10 may be used as a rehabilitation tool by injured athletes permitting them to regain function and strength and range of motion after an injury. Exercise machine 10 offers a smooth range of motion in a natural running or sprinting position and may do so with little or no resistance when all removable weights 38 are removed. This permits non-impact training by injured athletes and speeds the recovery and rehabilitation process of lower body injuries.

Although the present invention has been described with respect to particular embodiments, it is recognized that departures may be made from the embodiments shown herein and still be within the scope of the present invention, which is not limited to the illustrative details disclosed.

We claim:

1. An exercise machine for simulating running, comprising:

a. a frame, the frame having a forward portion and a rear portion, b. a shoulder harness connected to the forward portion of the frame for supporting the torso of the user on its ventral side, and preventing the forward movement of the user's body, c. two lever arms pivotally connected to the rear portion of the frame, d. a pedal assembly connected to each lever arm, for receiving the foot of the user, e. a means for connecting removable weights to each lever arm, so as to provide a torque about the respective pivot, and thereby impose a resistance to the leg movements of a user.

2. The exercise machine of claim 1 above, where the shoulder harness further comprises:

(a) a chest support, (b) two shoulder stops, and (c) two hand grips.

3. The exercise machine of claim 1 above, where the pedal assembly further comprises:

a. a bicycle pedal, b. a foot grip, c. a toe clip, d. an adjustment strap, and, e. a pedal stop for limiting the arc of travel of the pedal to less than 180 degrees.

4. The exercise machine of claim 1 above where the frame is supported by a plurality of adjustable foot assemblies.

5. The exercise machine of claim 4 above where each adjustable foot assembly comprises:

a. a base plate pivotally connected to a foot adjustment leg, the foot adjustment leg fitting telescopically into the rear portion of the frame, and, b. a means for locking the adjustment leg with the rear portion of the frame at a pre-determined position.

6. The exercise machine of claim 5 above where the means for locking the adjustment leg with the rear portion of the frame at a pre-determined position comprises:

a. a pull pin, and, b. an adjustment leg having spaced-apart openings for receiving and removably holding the pull pin, so that the rear portion of the frame is prevented from sliding below the position of the pull pin.

7. The exercise machine of claim 5 where the means for locking the adjustment leg with the rear portion of the frame at a pre-determined position comprises a gas-charged lift support, the gas-charged lift support connected between the adjustment leg and the rear portion of the frame.

8. An exercise machine for simulating running, comprising:

a. a frame, the frame further comprising:

(1) a forward portion and a rear portion, (2) a base, the base connected to the forward portion and the rear portion, (3) a plurality of foot assemblies attached to the base, each foot assembly further comprising:

(i) a base plate pivotally connected to a foot adjustment leg, the foot adjustment leg fitting telescopically into the rear portion of the frame, (ii) a pull pin, (iii) an adjustment leg having spaced-apart openings for receiving and removably holding the pull pin, so that the rear portion of the frame is prevented from sliding below the position of the pull pin, and, (iv) a gas-charged lift support, the gas-charged lift support connected between to the adjustment leg and the rear portion of the frame;

(4) first and second support pieces, the first support piece connected between the forward portion and the base, and the second support piece connected between the rear portion and the first support piece, and, (5) a plurality of pivots connected to the front portion of the frame, so that the front portion of the frame pivots when the rear portion of the frame is raised or lowered;

(b) a shoulder harness connected to the forward portion of the frame for supporting the torso of the user on its ventral side, and preventing the forward movement of the user's body, the shoulder harness further comprising:

(1) a chest support, (2) two shoulder stops, and (3) two hand grips;

c. two lever arms connected by a pivot to the rear portion of the frame;

d. two pedal assemblies, each connected to one of the lever arms at the end thereof opposite the end pivotally connected to the frame, each pedal assembly further comprising:

(1) a bicycle pedal, (2) a foot grip, (3) a toe clip, (4) an adjustment strap, and, (5) a pedal stop for limiting the arc of travel of the pedal to less than 180 degrees;

e. each lever arm further comprising a weight arm connected to the lever arm and a bar connected to the lever arm and the weight arm;

f. each weight arm having a hub connected thereto at the end of the weight arm opposite that connected to the lever arm, the hub receiving and holding removable weights, so as to provide a torque about the pivot and thereby impose a resistance to the leg movements of a user.

* * * * *